US006397646B1

(12) United States Patent
Doong

(10) Patent No.: US 6,397,646 B1
(45) Date of Patent: Jun. 4, 2002

(54) DOOR LOCK

(76) Inventor: Shing-Hwa Doong, 4 Fl., No. 6, Lane 6, Sec. 1, Hangchow S. Rd., Taipei (TW)

( * ) Notice: Subject to any disclaimer, the term of this patent is extended or adjusted under 35 U.S.C. 154(b) by 9 days.

(21) Appl. No.: 09/725,760

(22) Filed: Nov. 30, 2000

(51) Int. Cl.[7] ..... E05B 47/00

(52) U.S. Cl. ..... 70/279.1; 70/275; 70/277; 70/278.6; 70/278.7; 70/280; 70/281; 70/282; 70/283

(58) Field of Search ..... 70/279.1, 275, 70/277, 280, 281, 282, 283, 278.6, 278.7

(56) References Cited

U.S. PATENT DOCUMENTS 1,988,408 A * 1/1935 Allman ..... 70/278.6
1,995,889 A * 3/1935 Landry ..... 70/262
5,852,944 A * 12/1998 Collard, Jr. et al. ..... 70/278
6,032,500 A * 3/2000 Collard, Jr. et al. ..... 70/278.1

* cited by examiner

*Primary Examiner*—Katherine A. Matecki
*Assistant Examiner*—Carlos Lugo

(74) *Attorney, Agent, or Firm*—Fei-Fei Chao; Venable, Baetjer, Howard & Civiletti, LLP

(57) ABSTRACT

A door lock able to be unlocked by a key or a remote controller, has a body and a bolt provided inside the body. The bolt has a recess defined therein, and a tooth formed at a bottom side of a first end thereof. Two upper sheets and two lower sheets are respectively provided in an upper portion and a lower portion of the recess. Four links are pivotally connected end to end by four pivot pins to form a rhombic structure and respectively provided between the upper sheets and between the lower sheets. Two torsion springs are provided between the sheets and respectively mounted on two transversal pivot pins and pushing against two longitudinal pivot pins. An upper cam is mounted at an upper side of the bolt. A lower cam is mounted at a lower side of the bolt. The upper cam and the lower cam each have two tongues for pushing the upper sheets and the lower sheets inwards, and pushing the bolt to transversally move. A longitudinal pivot pin which is inserted through the upper sheets, extends out from the V-like slot and is movable along the V-like slot when the upper sheets, the lower sheets and the rhombic links are pressed by the upper cam or the lower cam. The lower cam can be stopped by the tooth when it is anticlockwise rotated over, and will not block the bolt. Thus, a user still can unlock the bolt by a key.

6 Claims, 7 Drawing Sheets

DOOR LOCK

BACKGROUND OF THE INVENTION

1. Field of the Invention

The present invention is related to a door lock, and more particularly to a door lock which can be locked or unlocked by a key or a remote controller.

2. Description of Related Art

A conventional door lock, which can be lock or unlocked by a key or a remote controller, is composed of a bolt, a first sliding block and a second sliding block installed in a recess of the bolt, four links connected end to end to form a rhombic structure and installed in the first sliding block and the second sliding block by four connecting pins, and two torsion spring respectively mounted on the two transversally opposite connecting pins and pushing the two longitudinally opposite connecting pins. A first cam driven by a key is mounted at a first side of the bolt, and a second cam driven by a motor is mounted at a second side of the bolt. The motor is able to be actuated by a remote controller. The first cam and the second cam each have two tongues with an included angle of 180 degrees for pushing the bolt outwards to lock the door. An inner cover is mounted on the bolt, and the connecting pins extend out from slots on the inner cover. The connecting pin in the first block can be moved along a V-like slot in an outer cover when the first sliding block or the second sliding block being pressed by the first cam or the second cam. A stop is formed at a central portion of the V-like slot for preventing the bolt from being pushed inwards to unlock the door by an improper external force.

However, because there are a lot of space in the first and second sliding blocks, the links are loosely installed in the sliding blocks and often shake as the sliding blocks are pressed. Furthermore, when the bolt is locked and the second cam is anticlockwise rotated over to locate its tongue after a rear end of the bolt, the bolt is blocked by the tongue and can not be unlocked by a key anyway.

Therefore, the invention provides an improved door lock to mitigate and/or obviate the aforementioned problems.

SUMMARY OF THE INVENTION

The main objective of the present invention is to provide a door lock of which links are stably installed therein and will not shake when being pressed.

Another objective of the present invention is to provide a door lock of which a cam driven by a motor can not block a bolt when the bolt is unlocked by a key.

Other objects, advantages and novel features of the invention will become more apparent from the following detailed description when taken in conjunction with the accompanying drawings.

DETAILED DESCRIPTION OF THE PREFERRED EMBODIMENT

Figure 1:
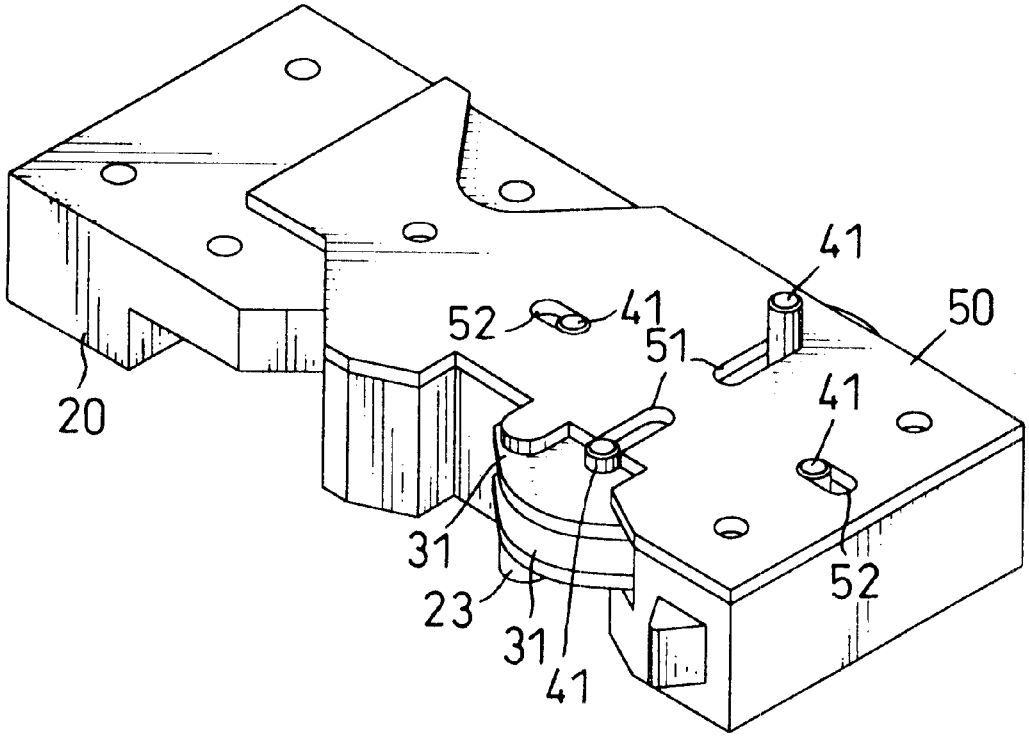
FIG. 1 is a perspective view of a bolt of door lock in accordance with the invention.
Figure 2:
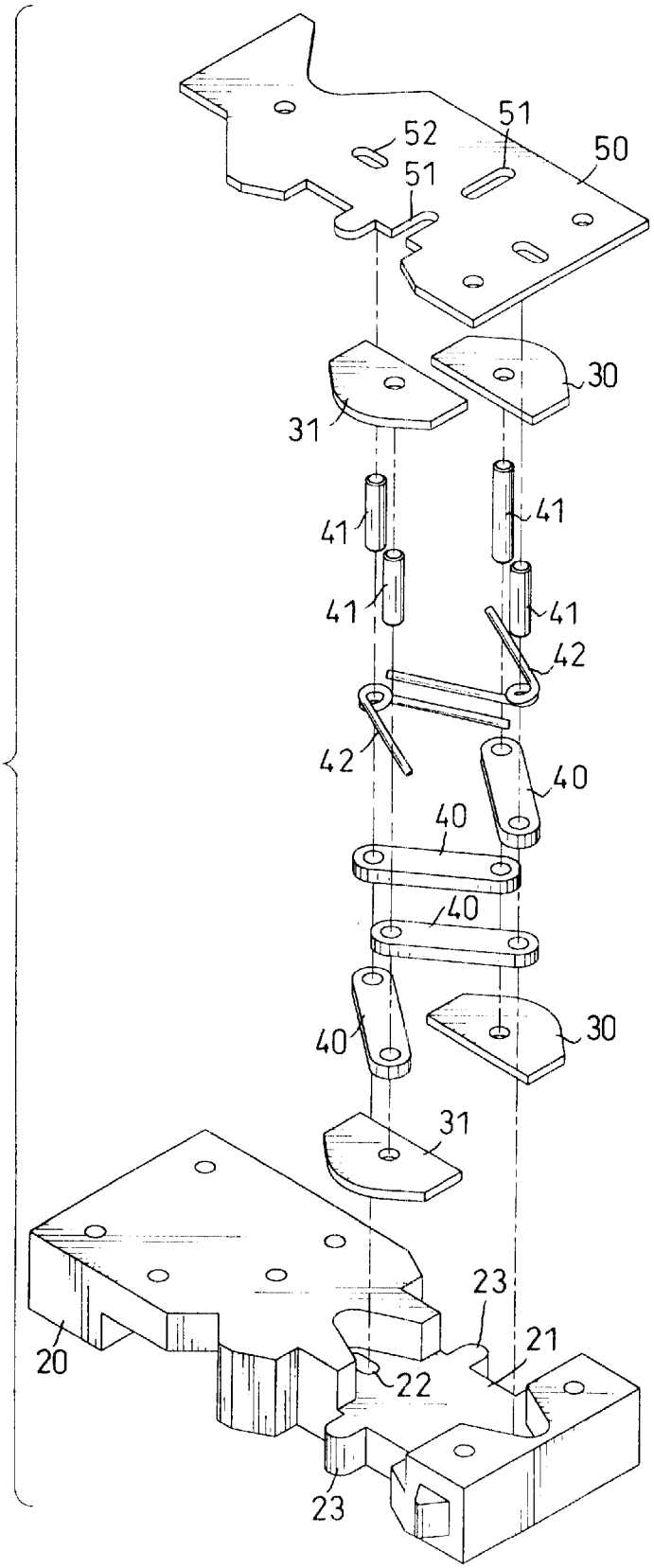
FIG. 2 is an exploded perspective view of the bolt of the door lock in accordance with the invention.
Figure 3:
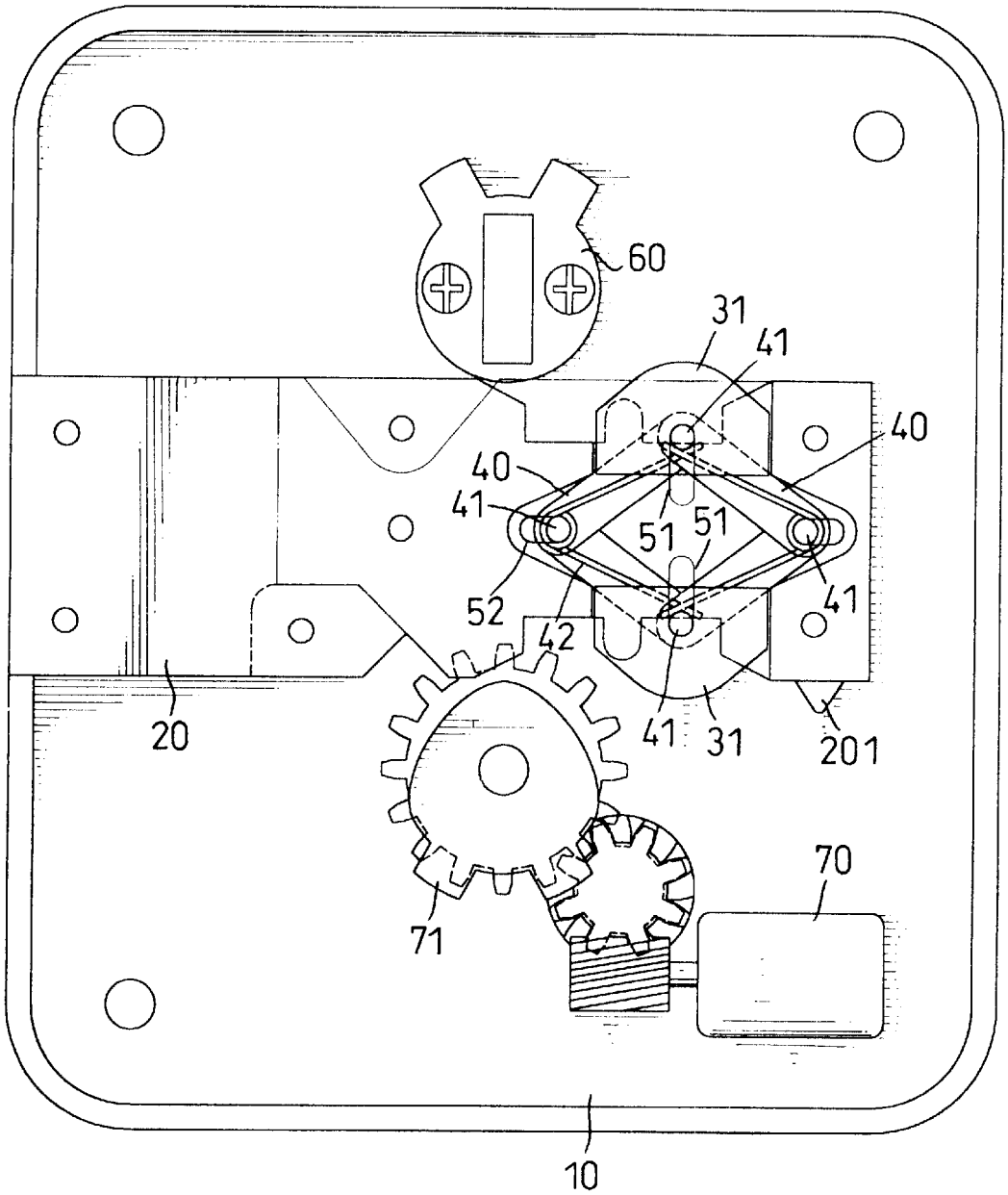
FIG. 3 is a front view of the door lock in accordance with the invention, wherein a panel of the door lock is eliminated.
Figure 4:
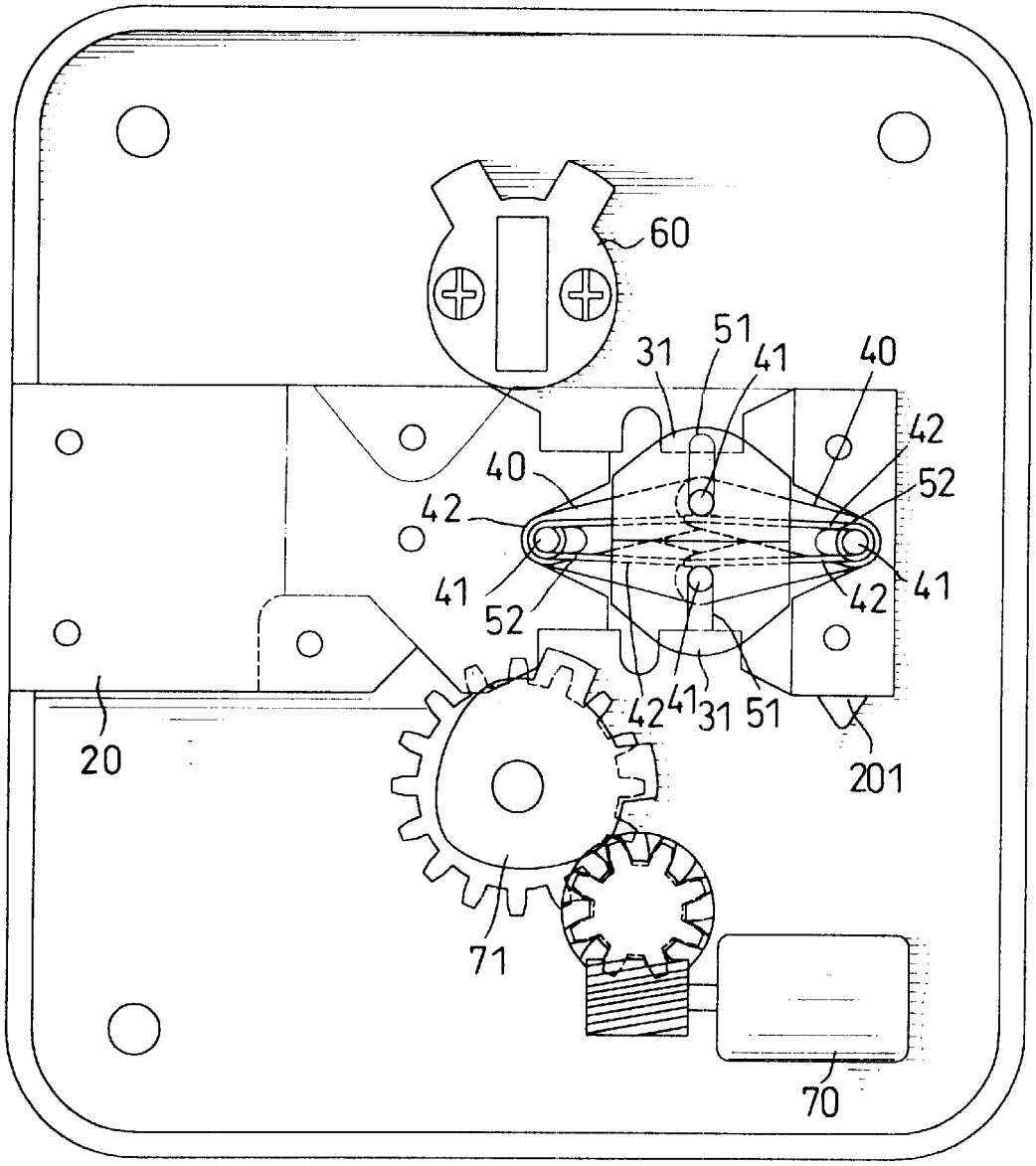
FIG. 4 is another front view of the door lock of FIG. 3, wherein a second cam driven by a motor is going to push a bolt outwards.

Referring to FIGS. 1–3, a door lock in accordance with the invention has a body (10) and a bolt (20) transversally movably provided inside the body (10). The bolt (20) has a recess (21) defined therein. Two first slots (22) are respectively transversally defined at two ends of the recess (21) and two protrusions (23) are respectively formed at an upper side and a lower side of the bolt (20). Two upper sheets (30) each with an upper arched edge is provided at an upper portion of the recess (21) and two lower sheets (31) each with a lower arched edge is provided at a lower portion of the recess (21). A tooth (201) is formed at a bottom side at a first end of the bolt (20).

Four links (40) are provided between the upper sheets (30) and between the lower sheets (31). The links (40) are pivotally connected end to end by four pivot pins (41) to form a rhombic structure. Two transversal pivot pins (41) are respectively received in the first slots (22) and two longitudinal pivot pins (41 ) are inserted through apertures (not numbered) in the upper sheets (30) and the lower sheets (31). Two torsion springs (42) are provided between the sheets (30, 31) and respectively mounted on the transversal pivot pins (41) and push against the longitudinal pivot pins (41).

A cover (50) mounted on the bolt (20) has two second slots (51) longitudinally defined therethrough for the longitudinal pivot pins (41) extending out. Two third slots (52) are transversally defined through the cover to correspond to the first slots (22) for the transversal pivot pins (41) extending out.

Figure 5:
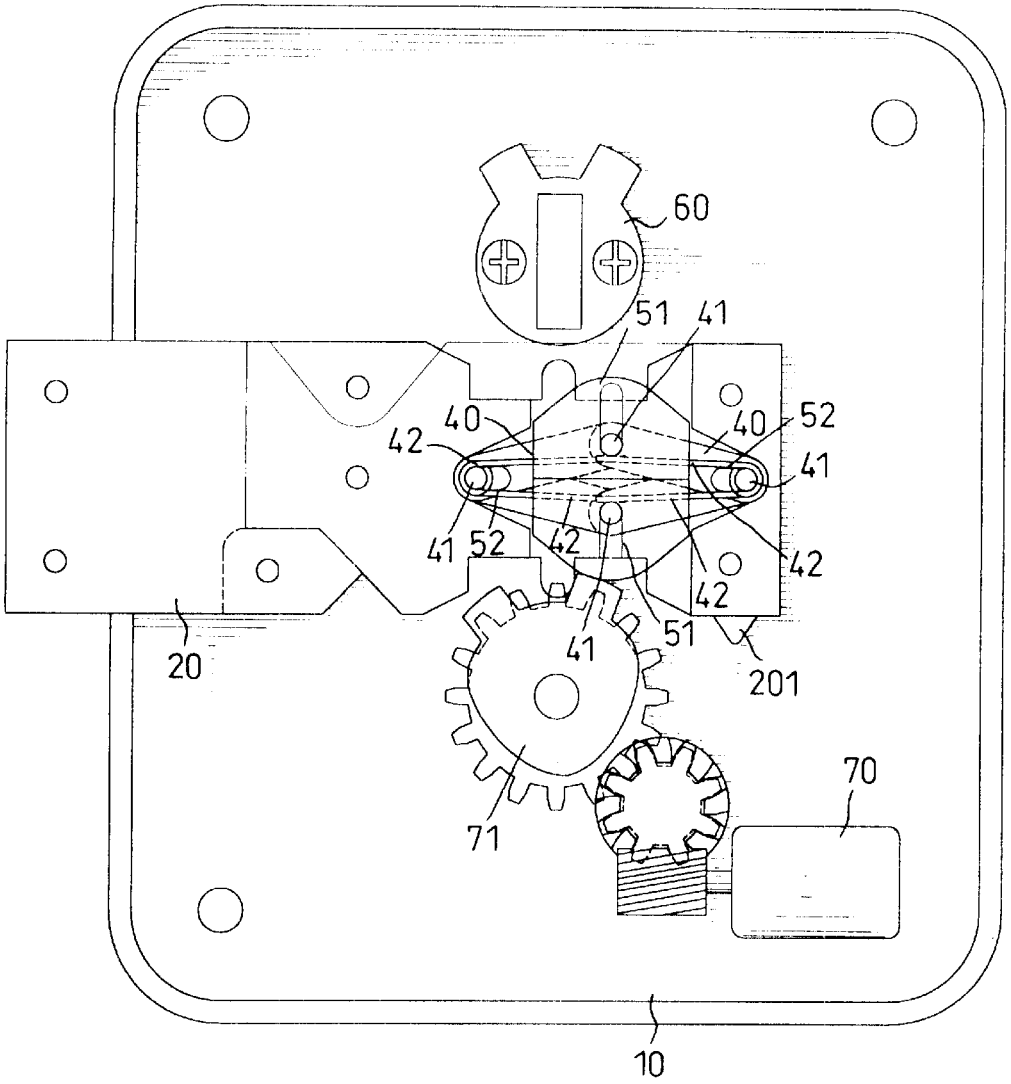
FIG. 5 is another front view of the door lock of FIG. 3, wherein the bolt is being pushed outwards by the second cam.

An upper cam (60) driven by a key is provided above the bolt (20), and a lower cam (71) driven by a motor (70) is provided beneath the bolt (20). The upper cam (60) and the lower cam (71) each have two tongues (neither numbered) with an included angle of 40–100 degrees. When the upper cam (60) or the lower cam (71) is rotated, the upper sheet (30) and the lower sheet (31) are pressed inwards and the bolt (20) is pushed to move by the tongues, as shown in FIG. 5. The motor (70) is able to be actuated by a remote controller (not shown or numbered). The lower cam (71) is continually varied in radius.

Figure 7:
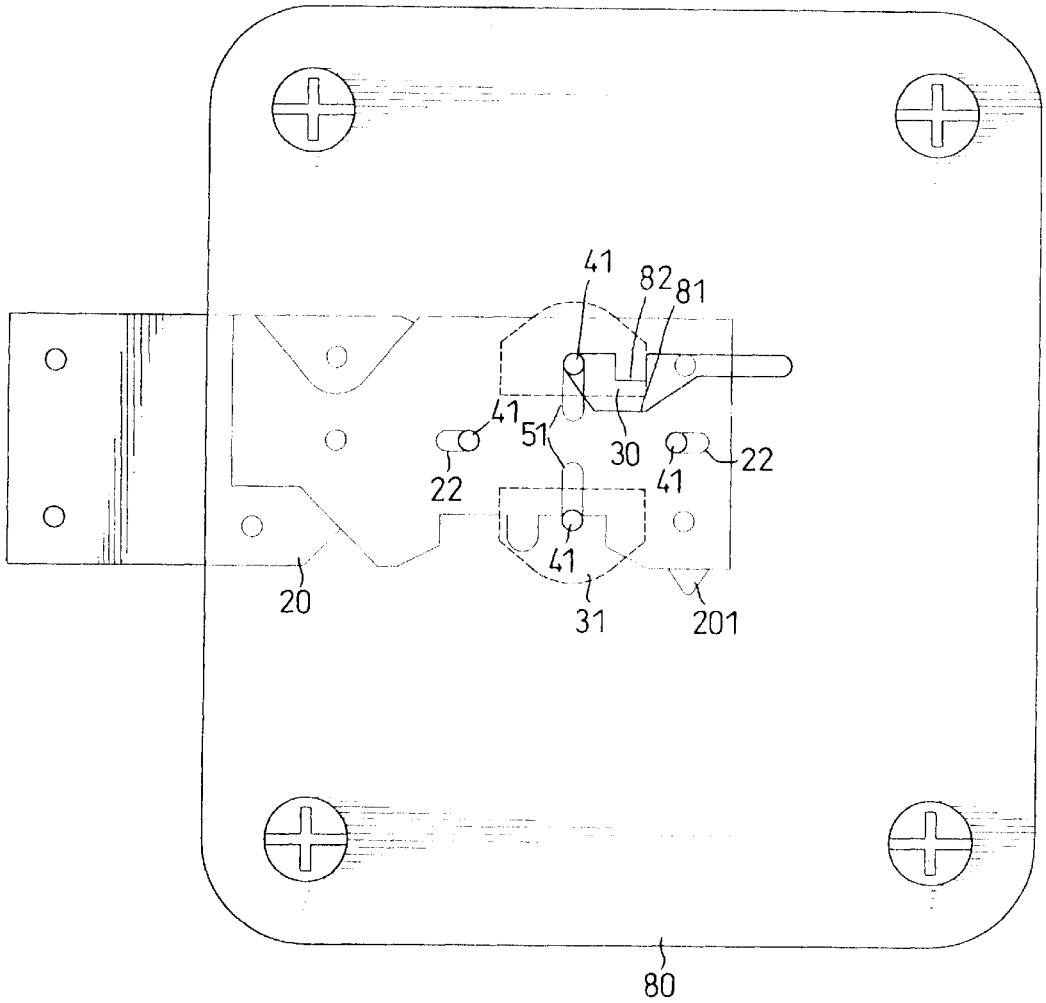
FIG. 7 is a front view the door lock in accordance with the invention.

A panel (80) covering the bolt (20) is mounted on the body (10), as shown in FIG. 7. The panel (80) has a V-like slot (81) defined therethrough and a stop (82) formed at a central portion of the V-like slot (81). The longitudinal pivot pin (41), which is inserted through the upper sheets (30), extends out from the V-like slot (81) and abuts an upper edge of the V-like slot (81) under the force of the torsion springs (42).

Referring to FIGS. 4–7, when a user rotates the upper cam (60) by a key or actuates the motor (70) to rotate the lower cam (71) by the remote controller for locking the door, the upper sheets (30) or the lower sheets (31) are pushed inwards by a first tongue of the upper cam (60) or the lower cam (71) and the torsion springs (42) are compressed, and the longitudinal pivot pin (41) in the upper sheets (30) is moved along the V-like slot (81) and will not blocked by the stop (82). Thus, the bolt (20) can be moved out to lock the door by a second tongue of the upper cam (60) or the lower cam (71) pushing the respective protrusion (23). Afterwards, the upper sheets (30) and the lower sheets (31) are pushed outwards under the force of the torsion springs (42).

When a user inversely rotates the upper cam (60) by a key or actuates the motor (70) to inversely rotate the lower cam (71) by the remote controller for unlocking the door, the upper sheets (30) or the lower sheets (31) are pushed inwards by the second tongue of the upper cam (60) or the lower cam (71) and the torsion springs (42) are compressed, and the longitudinal pivot pin (41) in the upper sheets (30) is moved back along the V-like slot (81) and will not blocked by the stop (82). Thus, the bolt (20) can be moved in to unlock the door by the first tongue of the upper cam (60) or the lower cam (71) pushing the respective protrusion (23). Afterwards, the upper sheets (30) and the lower sheets (31) are pushed outwards under the force of the torsion springs (42).

The bolt (20) is unable to be moved in if the upper sheets (30) is not pressed downwards to release the pivot pin (41) in the upper sheets (30) from the stop (82), which ensures the door can not be unlocked from outside by an improper method.

Figure 6:
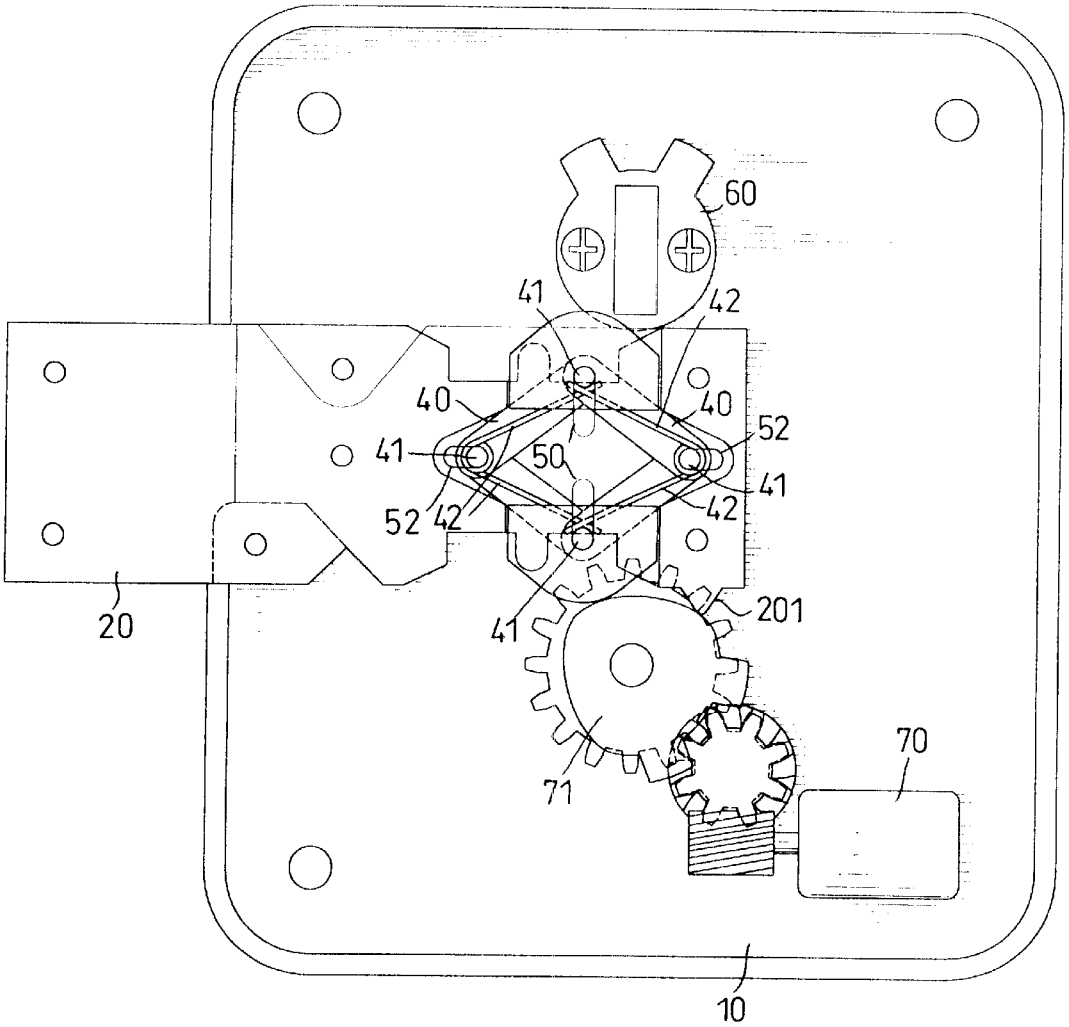
FIG. 6 is another front view of the door lock of FIG. 3, wherein the bolt is completely pushed outwards by the second cam.

Referring to FIG. 6, in a case that the bolt (20) is completely pushed out, if the lower cam (71) is anticlockwise rotated over by any uncontrollable reasons, because of its various radiuses, the lower cam (71) can be stopped by the tooth (201) and will not block the bolt (20). Thus, a user still can unlock the bolt (20) by a key.

From the above description, it is noted that the invention has the following advantages:

1. Because the links (40) are tightly fixed between the upper sheets (30) and the lower sheets (31), the links (40) are unable to shake when the upper sheets (30) and the lower sheets (31) are pressed inwards.
2. The tongues of the upper cam (60) and the lower cam (71) each have an included angle of 40–100 degrees smaller than 180 degrees in the conventional door lock, the time to lock or unlock the bolt (20) is shorten.
3. The bolt (20) has the tooth (201) to prevent the lower cam (71) from blocking the bolt (20), so that the user can unlock the bolt (20) by a key when the lower cam (71) is rotated over.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principle of the invention to the full extent indica by the broad general meaning of the terms in which the appended claims are expressed.

What is claimed is:

1. A door lock comprising:

a body (10);

a bolt (20) movably provided inside the body (10) and having a recess (21) defined therein, two first slots (22) transversally defined at two ends of a face defining the recess (21), two protrusions (23) respectively formed at an upper edge thereof and a lower edge thereof, and a tooth (201) formed at a first side of a first end thereof;

two upper sheets (30) each with an upper arched edge, provided in an upper portion of the recess (21);

two lower sheets (31) each with a lower arched edge, provided in a lower portion of the recess (21);

four links (40) pivotally connected end to end by four pivot pins (41) to form a rhombic structure and respectively provided between the upper sheets (30) and between the lower sheets (31), wherein two transversal pivot pins (41) are respectively received in the first slots (22) and two longitudinal pivot pins (41) are respectively inserted through the upper sheets (30) and the lower sheets (31);

two torsion springs (42) provided between the sheets (30, 31) and respectively mounted on the transversal pivot pins (41) and pushing against the longitudinal pivot pins (41);

a cover (50) mounted on the bolt (20), the cover (50) having two second slots (51) transversally defined therethrough and two third slots (52) longitudinally defined therethrough, the four pivot pins (41) respectively inserted through the second slots (51) and the third slots (52);

a first cam (71) mounted at a first side of the bolt (20), and a second cam (60) mounted at a second side of the bolt (20), the first cam (71) and the second cam (60) each having two tongues for pushing the upper sheets (30) and the lower sheets (31) inwards, and pushing the bolt (20) to transversally move, the first cam (71) is various in radius; and a panel (80) mounted on the body (10), the panel (80) having a V-like slot (81) defined therethrough and a stop (82) formed at a central part of the V-like slot (81), the longitudinal pivot pin (41) which is inserted through the upper sheets (30) extending out from the V-like slot (81) and being movable along the V-like slot (81) when the upper sheets (30), the lower sheets (31) and the rhombic links are pressed by the first cam or the second cam.

2. The door lock as claimed in claim 1, wherein the tongues of the first cam (71) have an included angle of 40–100 degrees.

3. The door lock as claimed in claim 1, wherein the tongues of the second cam (60) have an included angle of 40–100 degrees.

4. The door lock as claimed in claim 1, wherein the first cam (71) is driven by a motor (70).

5. The door lock as claimed in claim 4, wherein the motor (70) can be actuated by a remote controller.

6. The door lock as claimed in claim 1, wherein the second cam (60) is driven by a key.

* * * * *